United States Patent [19]

Lysiak

[11] Patent Number: 5,072,470

[45] Date of Patent: Dec. 17, 1991

[54] DEVICE FOR HOLDING BEDCLOTHES IN A FIXED POSITION ON A BED

[76] Inventor: Phillip J. Lysiak, 50 Sylvan Ave., Meriden, Conn. 06450

[21] Appl. No.: 647,178

[22] Filed: Jan. 24, 1991

Related U.S. Application Data

[63] Continuation of Ser. No. 440,897, Nov. 11, 1989, abandoned.

[51] Int. Cl.[5] ..... A47G 9/04

[52] U.S. Cl. ..... 5/496; 5/498

[58] Field of Search ..... 5/482, 494, 495, 496, 5/497, 498, 499; 24/72.3, 298, 300, 301, 302

[56] References Cited

U.S. PATENT DOCUMENTS

| | | | |
|---|---|---|---|
| 413,071 | 10/1889 | Lowe . | |
| 852,180 | 4/1907 | Hoffman . | |
| 1,156,740 | 10/1915 | Berdan . | |
| 1,195,874 | 8/1916 | Thurston | 24/72.5 |
| 1,206,808 | 12/1916 | Brent | 5/498 X |
| 1,438,475 | 12/1922 | Bisbing | 5/498 |
| 2,103,244 | 12/1937 | Briscoe | 24/72.5 |
| 2,284,778 | 6/1942 | Treiber | 5/320 |
| 2,321,394 | 6/1943 | King | 24/72.5 |
| 2,326,399 | 8/1943 | Shields | 24/72.5 |
| 2,328,474 | 8/1943 | Lewis | 24/300 |
| 2,459,497 | 1/1949 | Calabro | 24/72.5 |
| 2,727,253 | 12/1955 | Tomsil | 5/496 |
| 2,772,460 | 12/1956 | Berkowicz et al. | 24/72.5 |
| 2,857,643 | 10/1958 | Tomsil | 5/496 |
| 2,930,053 | 3/1960 | Nowels | 5/320 |
| 2,931,084 | 4/1960 | DeWitt | 24/72.5 |
| 3,092,848 | 6/1963 | Gronvold | 5/320 |
| 4,199,830 | 4/1980 | Ogata | 5/411 |
| 4,222,139 | 9/1980 | Svedberg-Reker | 5/498 |
| 4,662,016 | 5/1987 | Seeman | 5/508 |
| 4,698,880 | 10/1987 | Hamm | 24/72.5 |
| 4,716,608 | 5/1988 | Whitfield | 5/451 |
| 4,768,252 | 9/1988 | Ross | 5/497 |
| 4,862,541 | 9/1989 | Hutton et al. | 5/496 |
| 4,891,856 | 1/1990 | Thornhill | 5/496 |

*Primary Examiner*—Eric K. Nicholson

[57] ABSTRACT

A device (4) for holding any number or combination of bedclothes in a fixed position on a bed which comprises three component parts all positioned entirely under the uppermost cushioned structure of the bed: a) an anchor member (8) having a plurality of cooperable fastening means (15) disposed generally at peripheral points on it, the fastening means (15) counter poised against one another, b) a plurality of elasticized retaining members (7) having length adjusting mechanism (22) and cooperable fastening means (16) to those on the anchoring member, and c) a plurality of clamps (24) having pivotally connected gripping segments (25 and 26), a closure forcing element (27) and cooperably insertable associated independent coupling elements (37), said clamps connected to the retaining members. Any number of bedclothes, at any point adjacent to the lower edge of the uppermost cushioned structure, are wrapped around an associated independent coupling element (37) and the associated independent coupling element (37) and bedclothes are then inserted into the clamps. The bedclothes are then tucked under the uppermost cushioned structure of the bed and the elasticized retaining hand is then fastened to the anchoring member the cooperable fastening means. The bedclothes are fastened to the device at opposite sides of the bed and are so held in place by the device through opposing counterpoised force.

20 Claims, 4 Drawing Sheets

DEVICE FOR HOLDING BEDCLOTHES IN A FIXED POSITION ON A BED

This is a continuation of application Ser. No. 07/440,897, filed Nov. 11, 1989, now abandoned.

BACKGROUND OF THE INVENTION (a) Field of the Invention

This invention relates to a device for holding bedclothes in a fixed determined position on a bed.

(b) Description of the Prior Art

Bedclothes securing devices proposed in the past have many drawbacks and problems which make them impractical or ineffective for use today. For example, most devices are not effective as one increases the number of bedclothes to be held on a bed by a device or because the type or combination of types of bedclothes to be held cannot be accommodated by the device (U.S. Pat. Nos. 1,156,740, 2,326,399, 4,222,139, and 4,698,880). Since the clips or clamps which grip the bedclothes are primarily designed to hold only one item, some of the multiple gripped bedclothes slip free when little pulling force is applied to them. Other devices are ineffective because "Futon" type mattresses or childrens' mattresses are not heavy enough to provide sufficient frictional engagement to hold the device or a component thereof, placed under said mattresses, in place (U.S. Pat. Nos. 2,321,394 and 2,459,497). Still other devices do not work because some beds do not provide the necessary appendages to which the device must be attached (U.S. Pat. Nos. 1,206,808, 1,438,475, 852,180, 2,103,244, and 2,931,084). Other devices must be readjusted with each usage making them impractical for daily use (U.S. Pat. Nos. 413,071 and 2,326,399). Still other devices necessitate the attachment of components of the device directly and permanently to the bed, mattress, or bedclothes and thereby cause damage through their removal and are therefore impractical (U.S. Pat. Nos. 2,930,053 and 4,662,016). Other devices are impractical because they interfere with sleep due to their contact with a person sleeping, or, interfere with other usage of a bed such as sitting on the bed or placing objects on the bed (U.S. Pat. Nos. 1,156, 2,326,399, and 2,931,084). Still other devices cannot be used safely with present day electric blankets (U.S. Pat. Nos. 1,156,740, 2,326,399, and 3,092,848) because the devices will come in contact with the electrical components of the blanket and thereby cause malfunction of the blanket. Still other devices are impractical because they remain visible or produce lump-like bulges under the bedclothes when in usage and thus are detrimental to the aesthetic appearance of the bedclothes (U.S. Pat. Nos. 4,698,880 and 4,716,608). Another problem is that other devices do not allow the user to determine what locations on the bedclothes or on the bed need greater or lesser holding force because of the restriction of the particular design of that holding device. For example, if a user determines the need for more holding force to be applied to bedclothes on the side of a bed place against a wall and at the foot end of the bed, other devices are impractical because they do not provide a solution for this need (U.S. Pat. Nos. 2,284,778 and 4,199,830).

Most other devices are impractical (e.g., U.S. Pat. Nos. 2,103,244, 4,662,016, and 4,698,880) because they cannot be used with mattresses on beds which have headboards, footboards, or sideboards which are adjacent to the outer sides of the upper mattresses. The footboard, for example, because of its close proximity to the side of the mattress, will rub against the device causing the device to misfunction or in turn cause the device to damage the mattress or the bedclothes.

Most other devices are impractical because they attempt to secure the bedclothes by substituting a holding force through a device for the customary holding force of the "tucked in" method of bedclothes holding (e.g., U.S. Pat. Nos. 2,321,394, 2,326,399, and 4,698,880). These devices do not work because they do not enhance and strengthen the already existing holding force provided by tucking the bedclothes between the upper and lower mattresses.

Other devices are impractical because, since the clamps of these devices must provide sufficient force to hold the bedclothes securely, they are therefore difficult for women and children to operate (U.S. Pat. Nos. 2,103,244, 2,931,084, 4,662,016, and 4,698,880) due to the need for force to operate them.

Finally, most other devices are impractical because they do not adapt to the changing needs of the user. A user may wish different locations of the bedclothes to be held more or less securely at different times such as when ill, differing life stages of growing up, in warm weather versus cold, or when the bed is against a wall or not. For example, U.S. Pat. No. 4,768,252 only allows two locations on the bedclothes to be held at one time. To readjust where the bedclothes are to be held, either another device must be attached to the bedclothes or the device disengaged at two locations and then re-engaged to the bedclothes at another two locations.

The device for holding bedclothes in a fixed position on a bed made in accordance with this new invention therefore overcomes all of the aforementioned drawbacks and problems.

BRIEF SUMMARY OF THE INVENTION

The invention relates to a device for holding bedclothes (i.e., sheets, blankets, comforters, quilts, and the like) in a fixed position on a bed. It is an object of this invention to make a person(s) comfortable while sleeping on a bed because the bedclothes do not fall off of him/her during use of the invention. It is a further object of this invention to make the task of readjusting the bedclothes after bed use easier for the user because the bedclothes remain in a fixed position on the bed and therefore the bedclothes need less work to readjust them. Other objects of this invention are to:

(a) hold any number and combination of bedclothes, for example, either a single sheet, or a combination of a sheet, a blanket, and a comforter, securely in a fixed position on a bed;

(b) to provide a device which is readily effective on any sleeping device having one uppermost cushioned structured;

(c) to provide a device which does not require any adaptations to be made to or any appendages to be present on the bed, mattress, or bedclothes;

(d) to provide a device which does not require daily readjustment of itself to the bedclothes or to the bed;

(e) to provide a device which does not require permanent attachment of the device or a component thereof to the bed, mattress, or bedclothes;

(f) to provide a device which does not physically contact a user of a bed and thereby interfere with sleep or interfere with any other usage of a bed such as sitting upon or placing objects upon the bed;

(g) to provide a device which can be safely used to secure present day electric blankets in a fixed position on a bed because the device will not come in contact with any of the electrical components of the blanket;

(h) to provide a device, which when in use, will not be visible to the person viewing a bed either directly by seeing the device or indirectly by seeing telltale bumps on the bedclothes caused by the position of the device under the bedclothes or by any wrinkle in the bedclothes caused by the device;

(i) to allow the user to determine how much holding force will be applied to any combination of bedclothes at any given location on the bed;

(j) to provide a device which does not damage the headboard, footboard, or sideboards of a bed, which is not made inoperable by these boards, or which does not damage the mattress or bedclothes because of the frictional and pressured contact of the boards onto the device;

(k) to provide a device which enhances and strengthens the holding force of the customary "tucked in" method of securing bedclothes rather than substituting for it, (l) to provide a device which is easily operable by women and children and which does not require great force to operate the clamps of the device, and (m) to provide a device which is easily operable because it provides easily graspable components which in turn allow easy manipulation of attachment and detachment to the bedclothes.

Still another object is to provide a device which is simple, effective, and efficient to use, easily manufactured and inexpensively purchased, which maintains the bedclothes without loss of comfort to the person(s) using the bed due to constriction of the bedclothes onto the person.

In accordance with these objects, the device for holding bedclothes comprises:

(a) a plurality of bedclothes gripping means composed of a clamping means and an inner core coupling element; any combination and number of types of bedclothes at any point along their perimeter are wrapped lengthwise around the coupling element and then the bedclothes and said coupling element are inserted into the clamping means thereby being held securely, (b) a plurality of elastic retaining bands fitted with a suitable length adjusting mechanism, one of the plurality of aforementioned gripping means disposed at one end, and an easily attachable and detachable fastening means, which is cooperable to fastening means on the anchoring means, disposed at the opposite end, and (c) an anchoring means which is generally centrally located but entirely under the uppermost cushioned structure of a bed, having a plurality of fastening means, cooperable to fastening means on the retaining means, disposed at peripheral points on the anchoring means, and counterpoised against one another thereon, and generally disposed adjacent to the perimeter of the lower edge of the uppermost cushioned structure of the bed.

The bedclothes are securely fastened by the gripping means to the elastic retaining means which provides slight movement back and forth and therefore does not produce undue constriction of the bedclothes on the user. The retaining means with attached bedclothes in turn are easily attachable and detachable to the anchoring means which is under the uppermost cushioned structure, at a plurality of points around the perimeter of the lower edge of the uppermost cushioned structure of the bed counterpoised against identical fastening, retaining and gripping means on the opposite side of the bed, and, the bedclothes are thereby held securely in a fixed position on the bed. The entire device for holding bedclothes is located under the uppermost cushioned structure and does not extend out from under said cushioned structure.

Further objects and advantages of my invention will become apparent from a consideration of the drawings and ensuing description of it.

DETAILED DESCRIPTION OF THE PREFERRED EMBODIMENTS

Figure 1:
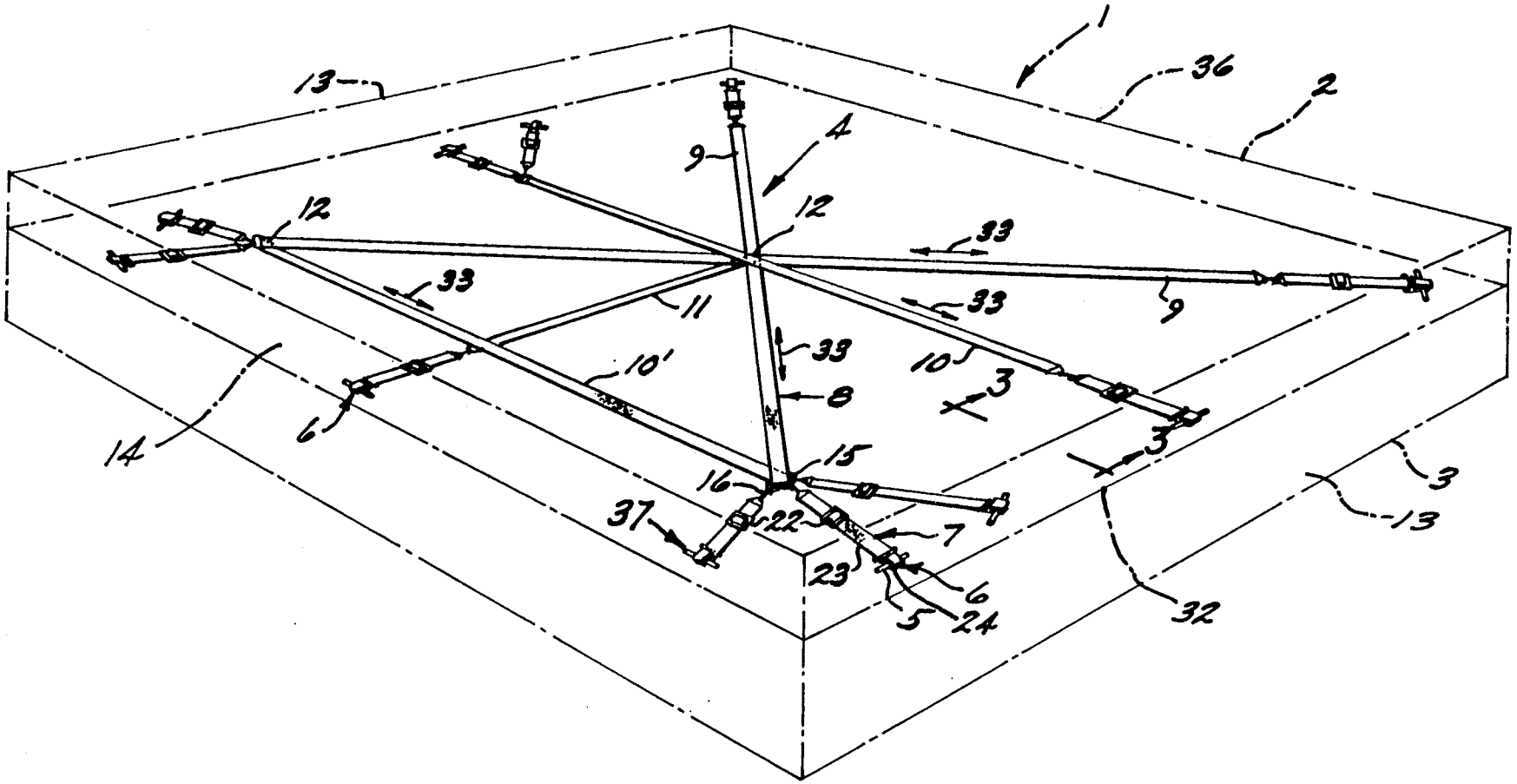
FIG. 1 is a perspective view illustrating the device for holding bedclothes positioned under the uppermost cushioned structure of a bed without gripping bedclothes.
Figure 2:
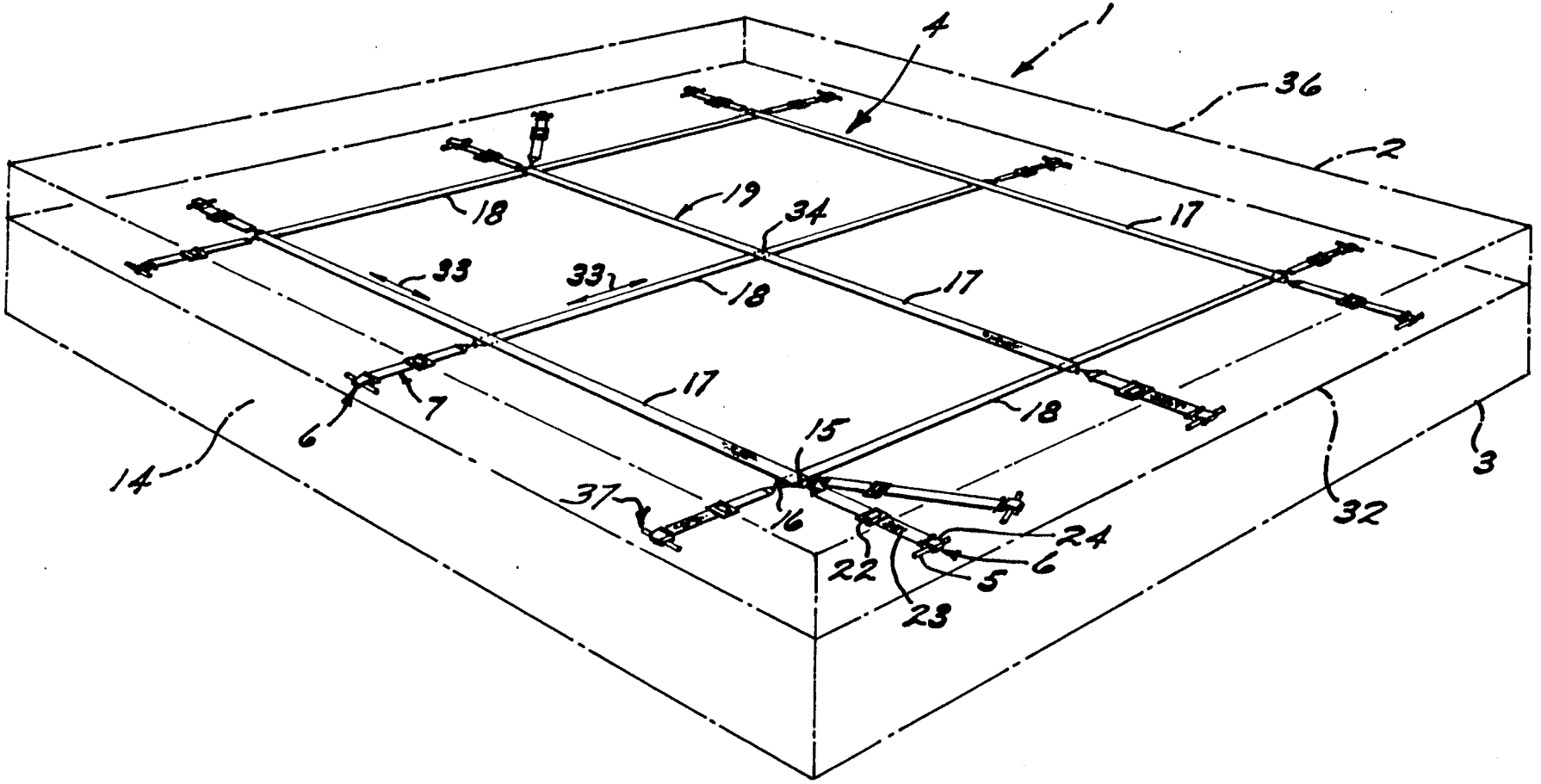
FIG. 2 is a perspective view illustrating an alternative preferred embodiment of a device for holding bedclothes positioned under the uppermost cushioned structure of a bed without gripping bedclothes.
Figure 3:
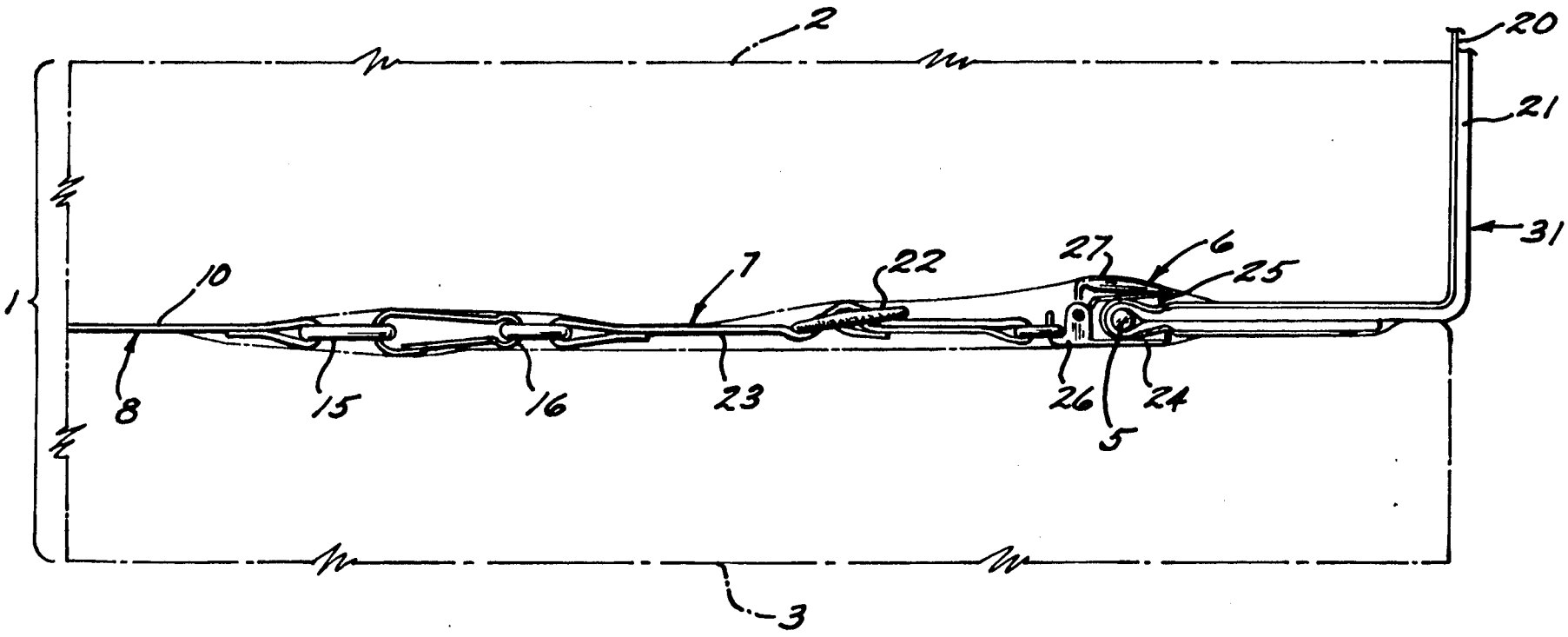
FIG. 3 is a cross-sectional view taken along lines 3—3 of FIG. 1.

The bed 1 described in FIG. 1, FIG. 2, and FIG. 3, shown in phantom drawing, is composed of an associated uppermost cushioned structure 2, commonly a mattress or a "Futon," mounted on a base member 3, commonly a box spring mattress or a platform. Base member 3 shall hereafter be used to denote the entirety of any bed or bed structure upon which the uppermost cushioned structure 2 is disposed. Bedclothes 31, seen in FIG. 3, here denote an upper cover sheet 20 and a blanket 21. However, bedclothes 31 may be composed of any number and combination of sheets, blankets, comforters, or the like placed on bed 1.

Figure 4:
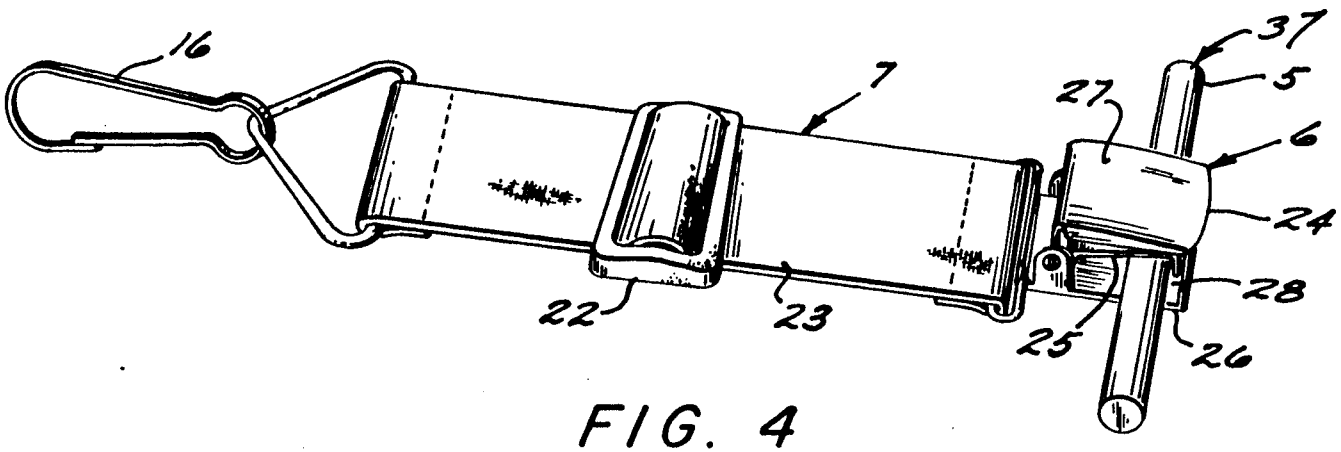
FIG. 4 is a perspective view of the retaining means attached to the bedclothes gripping means, showing in detail the easily attachable and detachable fastening means, adjustable slide, elastic band, clamping means, and independent bar positioned in the clamping means.

Referring to FIG. 1, FIG. 2, and FIG. 4, the inner core coupling elements 37 here denote independent bars 5. However, inner core coupling elements (37) may be composed of elements of differing shapes such as square dowels, rectangular dowels, or the like.

Referring to FIG. 1, the device for holding bedclothes 4 is disposed centrally under and entirely within the perimeter of lower edge 32 of uppermost cushioned structure 2 of bed 1. Device for holding 4 is comprised of a plurality of independent bars 5 around which bedclothes 31 are wrapped (seen in FIG. 3), an equal plurality of bedclothes gripping means 6 attached to one end of an equal plurality of bedclothes retaining means 7, and a generally centrally located anchoring means 8 to which retaining means 7 are easily attachable and detachable at a plurality of points on the periphery thereon. The anchoring means 8 is independent of, separate from, and not attached to the uppermost cushioned structure or the base member 3. Furthermore, the anchoring means 8 is not reliant on the upper mattress, lower mattress, or any other part of the bed structure for stability of placement or holding force.

Referring to FIG. 1, anchoring means 8 is composed of bands 9, 10, 10' and 11, preferably made of one inch wide cloth webbing. Other materials for bands 9, 10, 10' and 11, such as twine, ribbon, plastic, rubber, cord, synthetic material, elastic material, or the like may be used with equal satisfaction. As shown in FIG. 1, the bands are spacially arranged and attached to form a network of interconnecting bands with bands 9 diagonal to the mattress, extending directionally to or from opposite corners, bands 10 and 10' transverse to the upper mattress, and band 11 longitudinal to the upper mattress. Diagonal bands 9 are fastened together intermediate each end forming obtuse angles in an x-axis direction toward sides 13 of bed 1 and acute angles in a y-axis direction toward head end 36 and foot end 14 of bed 1. One transverse band 10 is fastened at its midpoint to the intersection of diagonal bands 9 and bisects the formed obtuse angles. Second transverse band 10' is fastened at its two terminal ends to the terminal ends of diagonal bands 9 at foot end 14 of bed 1. Finally, one longitudinal band 11 is fastened at one end to the midpoint of second transverse band 10' and at the other end to the intersection of two diagonal bands 9. All bands 9, 10, 10' and 11 are of such length that they do not extend beyond the perimeter of lower edge 32 of uppermost cushioned structure 2. All bands 9, 10, 10' and 11 are attached together at their respective joining points 12 by sewing (as shown in FIG. 1), stapling, riveting, or a like suitable fashion.

A plurality of easily attachable and detachable cooperable fastening means are disposed on the retaining means 7 and on the anchoring means 8. The co-operable fastening means are each comprised of first and second interconnecting members; the first member being attached to the anchoring means 8, and the second member being attached to the retaining means 7. The first members are disposed along a plurality of peripheral points on the anchoring means 8 at the terminal ends of bands 9, 10, 10' and at the terminal end of band 11 which end does not join the intersection of the two diagonal bands 9. The second member is attached to one terminal end of each of the retaining means 7. In FIG. 1, FIG. 2, and FIG. 3, D rings 15 comprise the first members disposed on anchoring means 8 and alternative anchoring means 19 (see FIG. 2), and snap hook fasteners 16 comprise the second members on the retaining means 7.

Other easily attachable and detachable fastening means such as snap fasteners, magnets, hooks, clips, and the like may be substituted satisfactorily provided that the fasteners on the retaining means are not fastened to each other or stacked one upon another thus relying for holding force on the initial first fastening to the anchoring element.

Anchoring means 8, seen in FIG. 1, and alternative anchoring means 19, seen in FIG. 2, need not be composed of a network of interconnecting bands. For example, a sheet of flexible material such as cloth, cardboard, plastic, rubber, or the like which allows easily attachable and detachable fastening means to be disposed along peripheral points thereon, the peripheral points not extending beyond the lower edge of the uppermost cushioned structure, may be substituted satisfactorily.

FIG. 2 is another embodiment of device for holding 4 wherein alternative anchoring means 19 is composed of three transverse bands 17 and three longitudinal bands 18 spacially arranged and interconnected to form a network of four interconnected rectangles having one common corner 34. D rings 15 are disposed on anchoring means 19 at peripheral points adjacent to the perimeter of lower edge 32 of uppermost cushioned structure 2 of bed 1 but not extending outwardly beyond said perimeter, and disposed at the terminal ends of transverse bands 17 and longitudinal bands 18. D rings 15 are contrapositioned, on anchoring bands 17 and 18 in FIG. 2, and on bands 9, 10, 10' and 11 in FIG. 1, to establish thereon a network of fastening means which counteract each other with opposing force, which network establishes opposing counter holding forces in the direction of opposing arrows 33, when holding device 4 is attached to bedclothes 31.

Bedclothes retaining means 7, best seen in FIG. 4, is composed of a length of flexible element preferably made of a band 23 of elastic webbing, adjustable lengthwise by the disposition of a suitable length adjusting mechanism such as an adjustable slide 22. At one terminal end of retaining band 23 is disposed a snap hook fastener 16 which is cooperably fastenable to D rings 15 disposed on anchoring means 8 or alternative anchoring means 19.

At the other terminal end of retaining band 23 is disposed bedclothes gripping means 6, best seen in FIG. 4 without engaging bedclothes, and best seen in FIG. 3 engaging bedclothes 31. Gripping means 6 is composed of a clamping means 24 which has first 25 and second 26 pivotally connected gripping segments, which form, when in a closed position, an opening 28 along with the width of clamping means 24 interjacent the clamping ends of pivotally connected segments 25 and 26, a closure forcing element 27, and, an independent bar 5 of wood, metal, plastic, or the like, having a diameter less than that of opening 28 and a length longer than that of the width of clamping means 24, and having an external shape and surface area constructed to be cooperably grippable inside opening 28 of clamping means 24.

Figure 6:
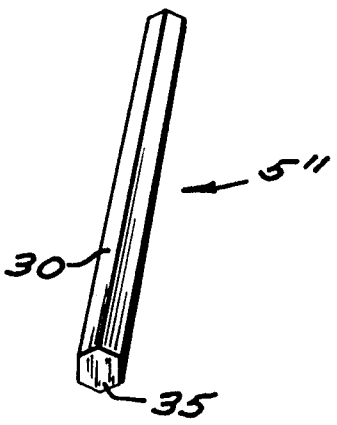
FIG. 6 is a perspective view of another alternative bar with a polygonal surface area of multiple rectangular planes.
Figure 5:
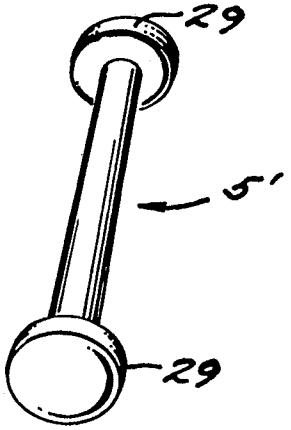
FIG. 5 is a perspective view of an alternative bar with flanged opposite ends.

FIG. 5 is a first alternative bar 5' which has two flanged end structures 29 that are formed as one piece with bar 5' or are separate elements attached to the opposite ends of bar 5'. The two flanged end structures 29 have a diameter greater than the diameter of the opening 28 whereby the flanged end structures 29 lie adjacent to but outside of said opening 28. FIG. 6 is a second alternative bar 5'' which has a polygonal surface area structure 35 of multiple rectangular planes 30 parallel and adjacent to one another. Suspender-type clips and closepin-type clips have been found suitable as the bedclothes clamping means.

Referring to FIG. 3, bed sheet 20 and blanket 21, at any location along their perimeter, are first wrapped around the length of bar 5 and subsequently inserted into clamping means 24 which is attached to adjustable lengthwise retaining band 23. The insertion of bedclothes 31 and bar 5 into clamping means 24 is easily accomplished because the bar 5 is longer than the clamping means 24 and because the pivotally connected first and second segments 25 and 26 easily pivot open to produce an opening 28 larger than necessary to accommodate bedclothes 31 and bar 5 without the need of force to push them into the clamping means. The clamping means gripping force is engaged by operation of closure forcing element 27. Bedclothes 31 are wrapped around bar 5 which cannot be extracted out of opening 28 withou de-engagement of closure forcing element 27 and therefore bedclothes 31 are also held in clamping means 24. Bedclothes 31 are then tucked under uppermost cushioned structure 2 and the overall holding device 4 concealed entirely under uppermost cushioned structure 2. Retaining band 23 is then easily attached to D ring 15 on anchoring means 8 by snap hook fastener 16, and bedclothes 31 are held in a fixed position on the bed with opposite sides of the bedclothes being held by each other by fastening means, retaining means 7 and gripping means 6 counterpoised on anchoring means 8 against identical fastening means, retaining means 7 and gripping means 6 on the opposite side of the bed. The effective holding force of the device 4 is greatly enhanced because of the overall size of the device 4 which necessitates that the bedclosthes 31 be attached to the device 4 at peripheral locations on the bedclothes 31 which do not lie outside of the perimeter of the lower edge 32. The bedclothes 31 therefore make frictional contact with the upper and lower edges and the top, sides, and under surfaces of the uppermost cushioned structure 2 and thereby are held very securely in place.

Referring to FIG. 1 and FIG. 2, it will be clear that any desired number of retaining means 7 with attached gripping means 6 may be easily attachable and detachable to and from any one D ring 15 on anchoring means 8 or 19 thereby providing the greatest optional holding force at any desired or necessary location on bedclothes 31.

It will also be clear that each fastening of any plurality of retaining means 7 to anchoring means 8 at any D ring 15 is independent of each other and unfastening of any one retaining means 7 does not unfasten any other retaining means 7.

While the above description of the preferred embodiments contains many specificities, these should not be construed as limitations on the scope of this invention. Other variations are possible. For example, "O" rings may be substituted for D rings 15 of this invention. For another example, the anchoring means may be comprised of a centrally located ring or rectangle with retaining bands attached to this means and extending outwardly toward but not beyond the perimeter of the lower edge of the uppermost cushioned structure. Many other variations are possible within the general concepts of these preferred embodiments and therefore these preferred embodiments should not limit the scope of this invention.

I claim and wish to secure by Letters Patent:

1. A device for holding bedclothes in a fixed position on a bed having an associated uppermost cushioned structure and a structure upon which said uppermost cushioned structure is disposed, which comprises:

a. a plurality of bedclothes gripping means for releasably grasping a plurality of bedclothes therein, each of said bedclothes gripping means having clamping means for detachably grasping a plurality of bedclothes at any one location therein, b. a plurality of bedclothes retaining means for holding said gripping means to an anchoring means, and c. an anchoring means for connecting one of said bedclothes retaining means and bedclothes gripping means on one side of the bed to a plurality of said bedclothes retaining means and bedclothes gripping means on another side of the bed; said anchoring means comprising a member which is independent of and separate from said uppermost cushioned stucture and said structure upon which said uppermost cushioned structure is disposed; said device being disposed under said uppermost cushioned structure of a bed and being of overall dimension substantially not extending outwardly beyond the perimeter of the lower edge of said uppermost cushioned structure of a bed, whereby said overall dimension causes a person to attach said device to said bedclothes at a plurality of locations substantially under said uppermost cushioned structure and so causing said bedclothes to be positioned into maximum frictional contact with the upper and the lower edges, and the top, sides, and under surfaces of said uppermost cushioned structure and so being held securely thereon.

2. The device of claim 1 wherein said bedclothes retaining means comprises a length of flexible element which stretches elastically in a lengthwise direction and further including a length adjusting member disposed on said bedclothes retaining means.

3. The device of claim 1 wherein said anchoring means comprises an arrangement of interconnecting longitudinal and transverse bands fastened together into a substantially rectangular network of bands.

4. The device of claim 1 wherein said anchoring means comprises a network of interconnecting longitudinal, transverse, and diagonal bands.

5. A device for holding bedclothes in a fixed position on a bed having an associated uppermost cushioned structure and a structure upon which said uppermost cushioned structure is disposed, which comprises:

a. a plurality of bedclothes gripping means for releasably grasping a plurality of bedclothes therein, each of said bedclothes gripping means having clamping means for detachably grasping a plurality of bedclothes at any one location therein, b. a plurality of bedclothes retaining means for holding said gripping means to an anchoring means, c. an anchoring means for connecting one of said bedclothes retaining means and bedclothes gripping means on one side of the bed to a plurality of said bedclothes retaining means and bedclothes gripping means on another side of the bed; said anchoring means comprising a member which is independent of and separate from said uppermost cushioned stucture and said structure upon which said uppermost cushioned structure is disposed, and d. a plurality of co-operable fastening means for attachably and detachably fastening said bedclothes retaining means to said anchoring means; each of said plurality of co-operable fastening means comprising first and second interconnecting members, said first member being attached to said anchoring means, said second member being attached to said retaining means; said first member having means for attaching directly to a plurality of said second members; said second member being directly attached to said first member separate and independent of any of said second members.

6. The device of claim 5 wherein said anchoring means comprises a member including a plurality of said first members disposed generally at peripheral points thereon, such that these points lie substantially adjacent to the perimeter of the lower edge of the uppermost cushioned structure of a bed but do not lie outside said perimeter.

7. The device of claim 5 wherein said anchoring means comprises a member including a plurality of said first members disposed generally at peripheral points thereon, such that these points are arranged to establish a network of fastening means which counteract each other with opposing force.

8. The device of claim 5 wherein said first member comprises a ring.

9. The device of claim 5 wherein said anchoring means comprises an arrangement of interconnecting longitudinal and transverse bands fastened together into a substantially rectangular network of bands.

10. The device of claim 5 wherein said anchoring means comprises a network of interconnecting longitudinal, transverse, and diagonal bands.

11. The device of claim 5 wherein said second member comprises means co-operably fastenable to a ring.

12. The device of claim 11 wherein said means cooperably fastenable to a ring comprises snap hook fasteners.

13. The device of claim 5 wherein said device is disposed under said uppermost cushioned structure of a bed and being of overall dimension substantially not extending outwardly beyond the perimeter of the lower edge of said uppermost cushioned structure of a bed.

14. A device for holding bedclothes in a fixed position on a bed having an associated uppermost cushioned structure and a structure upon which said uppermost cushioned structure is disposed, which comprises:

a. a plurality of bedclothes gripping means for releasably grasping a plurality of bedclothes therein, each of said bedclothes gripping means having clamping means for detachably grasping a plurality of bedclothes at any one location therein, said gripping means comprising:

1. a clamping means for releasably grasping said bedclothes therein, comprising first and second pivotally connected gripping segments and a closure forcing element, which, when in a closed position, forms an opening along the width of said clamping means and interjacent the clamping ends of said first and second pivotally connected gripping segments, and 2. an inner core coupling element for fixing said bedclothes in said clamping means, having a diameter less than the diameter of said opening formed by the pivotally connected gripping segments, having an external shape and surface area which is co-operably gripped inside said opening, and having a length greater than said width of said clamping means.

b. a plurality of bedclothes retaining means for holding said gripping means to an anchoring means, and c. an anchoring means for connecting one of said bedclothes retaining means and bedclothes gripping means on one side of the bed to a plurality of said bedclothes retaining means and bedclothes gripping means on another side of the bed; said anchoring means comprising a member which is independent of and separate from said uppermost cushioned stucture and said structure upon which said uppermost cushioned structure is disposed; whereby said bedclothes are wrapped around the length of said inner core coupling element and the wrapped bedclothes and said inner core coupling element are easily inserted into said clamping means by holding the portion of the bedclothes and the length of said inner core coupling element which extends beyond the width of said clamping means and thereby being attachably and detachably gripped without said inner core coupling element slipping laterally out from said clamping means.

15. The device of claim 14 wherein said inner core coupling element comprises a bar.

16. The device of claim 14 wherein said inner core coupling element comprises a polygonal surface area structure comprised of a plurality of rectangular planes disposed parallel and adjacent to each other and lengthwise along the coupling element.

17. The device of claim 14 wherein said anchoring means comprises an arrangement of interconnecting longitudinal and transverse bands fastened together into a substantially rectangular network of bands.

18. The device of claim 14 wherein said anchoring means comprises a network of interconnecting longitudinal, transverse, and diagonal bands.

19. The device of claim 14 wherein said inner core coupling element further comprises two flanged end structures, each disposed generally at opposite lengthwise ends of the coupling element, and each having a diameter greater than said diameter of said opening formed by the pivotally connected gripping segments, whereby the structures lie adjacent to but outside of said opening.

20. The device of claim 14 wherein said device is disposed under said uppermost cushioned structure of a bed and being of overall dimension substantially not extending outwardly beyond the perimeter of the lower edge of said uppermost cushioned structure of a bed.

* * * * *